US005560727A

United States Patent [19]

Vaupel

[11] Patent Number: 5,560,727

[45] Date of Patent: Oct. 1, 1996

[54] LIPSTICK CASE

[75] Inventor: Wilfried Vaupel, Haan, Germany

[73] Assignee: Marbert GmbH, Germany

[21] Appl. No.: 428,836

[22] Filed: Apr. 25, 1995

Related U.S. Application Data

[63] Continuation of Ser. No. 90,122, filed as PCT/EP92/00081, Jan. 17, 1992, published as WO92/12651, Aug. 6, 1992, abandoned.

[30] Foreign Application Priority Data

Jan. 24, 1991 [DE] Germany ..... 9100794 U

[51] Int. Cl.[6] ..... A45D 40/06; A45D 40/04; A45D 40/12

[52] U.S. Cl. ..... 401/78; 401/74; 401/80; 401/87

[58] Field of Search ..... 401/78, 87, 80, 401/84, 74, 83

[56] References Cited

U.S. PATENT DOCUMENTS

| | | | |
|---|---|---|---|
| 1,391,253 | 9/1921 | Hornung . | |
| 1,567,467 | 12/1925 | Rocherolles | 401/84 |
| 2,014,697 | 9/1935 | Reichenbach . | |
| 2,409,658 | 10/1946 | Book . | |
| 3,539,266 | 11/1970 | Hultgren | 401/78 |

FOREIGN PATENT DOCUMENTS

| | | | |
|---|---|---|---|
| 671388 | 5/1952 | France | 401/74 |
| 442991 | 7/1925 | Germany | 401/83 |
| 89 15 516 | 11/1990 | Germany . | |
| 91 00 794 | 5/1991 | Germany . | |
| 381287 | 10/1932 | United Kingdom . | |
| 583343 | 12/1946 | United Kingdom . | |
| 2143212 | 2/1985 | United Kingdom . | |

*Primary Examiner*—Steven A. Bratlie
*Attorney, Agent, or Firm*—Finnegan, Henderson, Farabow, Garrett & Dunner, L.L.P.

[57] ABSTRACT

In the lipstick case having a lipstick mechanism, comprising a slotted tube (5), a tube (4) which rotatably surrounds the slotted tube (5) and exhibits an internal thread (15), and a lipstick holder (6) which is arranged so that it can move in the slotted tube (5), the lipstick holder (6) is provided with guide cams (13) which engage through the slots of the slotted tube (5) into the thread turns. Furthermore, the lipstick holder is provided with spring elements (8) which have cams (7) which are supported on the slotted tube, thereby forming rear-engagement lugs (21), and the slotted tube is provided with recesses (9) into which the cams (7) of the spring elements engage.

7 Claims, 2 Drawing Sheets

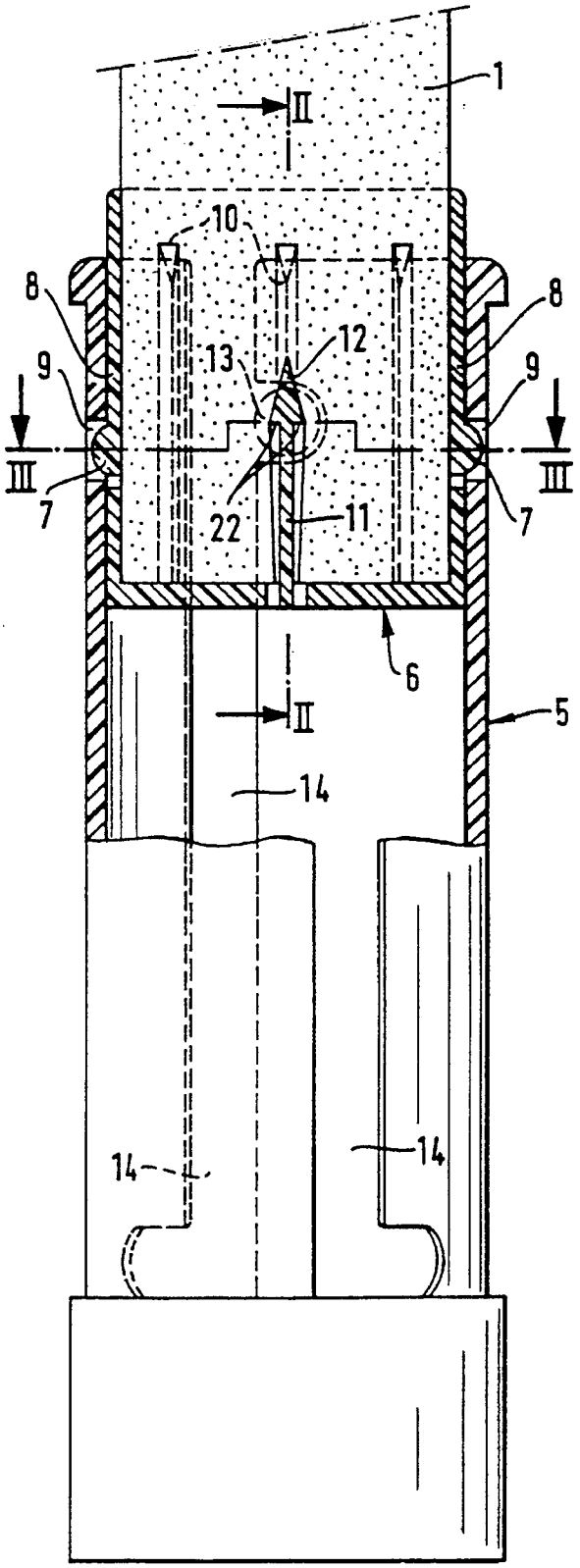
Fig. 1
Fig. 2
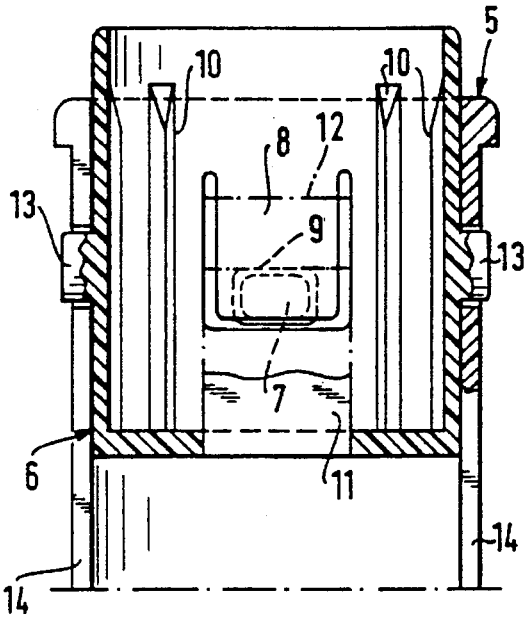
Fig. 3
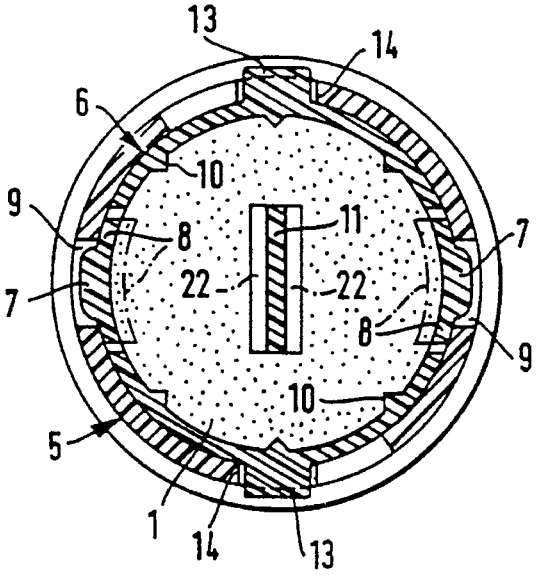

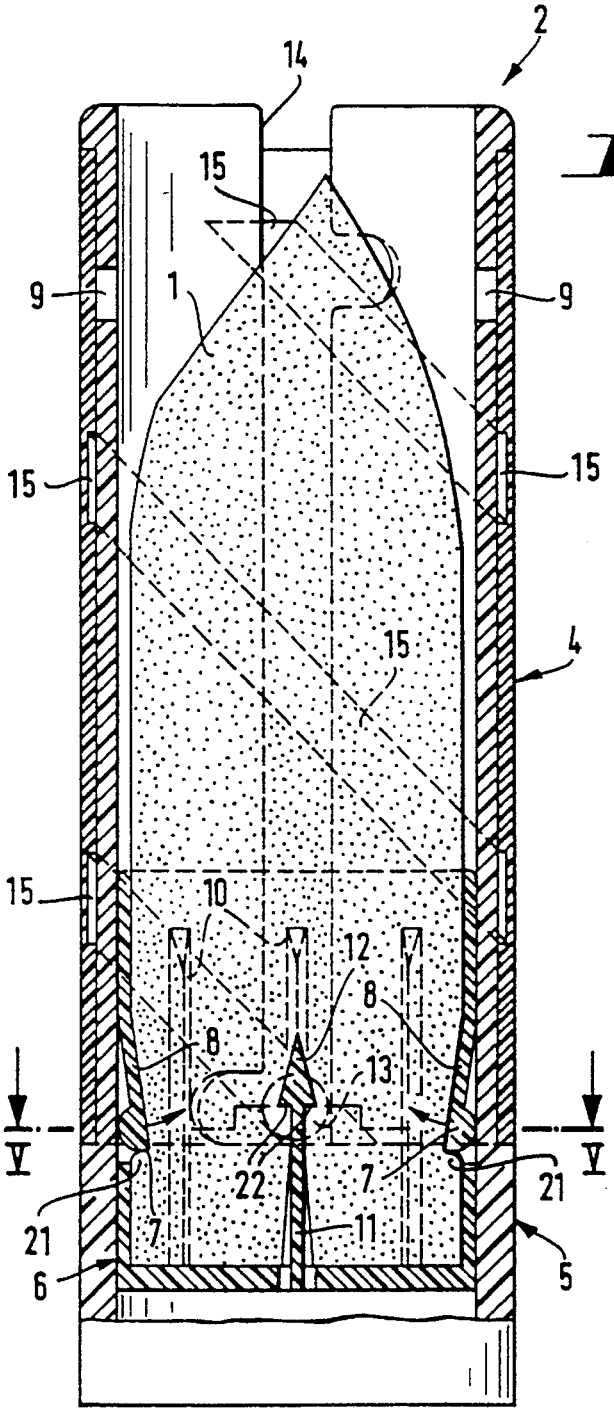
Fig. 4
Fig. 5
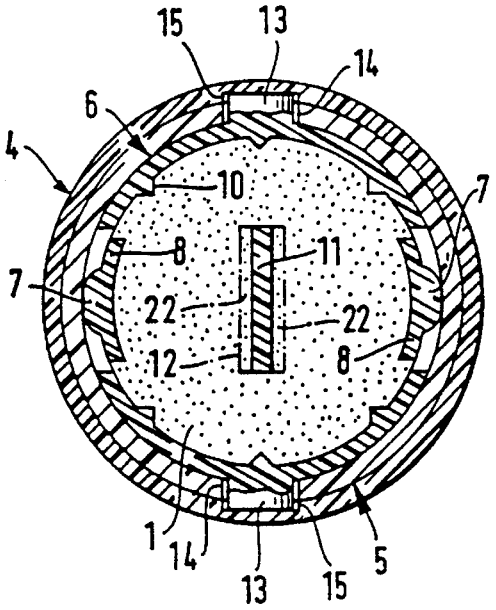

LIPSTICK CASE

This application is a continuation of application Ser. No. 08/090,122, filed as PCT/EP92/00081 Jan. 17, 1992, published as WO92/12651 Aug. 6, 1992, now abandoned.

The invention relates to a lipstick case having a lipstick mechanism, comprising a slotted tube, a tube which rotatably surrounds the slotted tube and exhibits an internal thread, and a lipstick holder which is arranged so that it can move in the slotted tube and is provided with spring elements and guide cams which engage through the slots of the slotted tube into the thread turns.

Lipstick cases of the abovementioned type are known from GB-A-2 143 212. The disadvantage of these cases is that, when filling the lipstick holder, the lipstick passes into the lipstick mechanism. The invention seeks to overcome this problem.

The object is achieved by the invention in that the spring elements have movable ends which extend to the base of the holder and on which cams are arranged which are supported on the slotted tube, thereby forming rear-engagement lugs, and the slotted tube is provided with recesses into which the cams of the spring elements engage.

A pin with a tip having rear-engagement lugs can be arranged on the base of the lipstick holder.

The advantages of the invention are regarded as being essentially that, by means of the rear-engagement lugs, the lipstick is prevented from slipping out of the lipstick holder.

In the following, the invention is explained in more detail by means of drawings representing merely one embodiment. In the drawings:

FIG. 1 shows the slotted tube of the lipstick case with the lipstick holder extended and the lipstick inserted, partly in section;

FIG. 2 shows the section along II—II in FIG. 1;

FIG. 3 shows the section along III—III in FIG. 1;

FIG. 4 shows the lipstick case with the lipstick holder retracted, partly in section and FIG. 5 shows the section along V—V in FIG. 4.

The lipstick case (2) having a lipstick mechanism comprises a slotted tube (5) which is surrounded by a rotatable tube (4) which has an internal thread (15) (double thread). The lipstick holder (6) provided with guide cams (13) is arranged so that it can move in the slotted tube (5). Its guide cams (13) engage through the slots (14) of the slotted tube (5) into the thread turns (15) of the tube (4). The lipstick holder (6) is provided with spring elements (8) which have cams (7). When the lipstick holder (6) is extended, these cams (7) engage into recesses (9) which the slotted tube (5) exhibits at its open end. The lipstick case (2) is provided with lipstick (1) when the lipstick holder (6) is extended (FIG. 1). When the lipstick holder (6) is retracted by a corresponding rotation of the tube (4), the cams (7) leave the recesses (9) and are supported on the slotted tube (5). In this arrangement, the spring elements are pressed into the lipstick. The resulting rear-engagement lugs (21) enter into a positively locking connection with the lipstick (1), which connection prevents the lipstick (1) from slipping out of the lipstick holder (6). The ribs (10) secure the lipstick (1) against axial twisting in the lipstick holder (6). The adhesion of the lipstick (1) in the lipstick holder (6) can be further improved by a pin (11) which is arranged on the base of the lipstick holder (6) and has a tip (12) provided with rear-engagement lugs (22).

I claim:

1. A lipstick case having a lipstick moving mechanism, comprising:

an inner tube having slots, an open end configured to allow lipstick to pass therethrough and recesses adjacent to the open end;

an outer tube rotatably surrounding the inner tube and having an internal thread with thread turns; and a lipstick holder arranged to move in the inner tube and having spring elements and guide cams engaging the thread turns through the slots of the inner tube, the spring elements having movable ends extending to a base of the holder and secondary cams on the movable ends, the secondary cams being supported on an inner surface of the inner tube to form rear-engagement lugs and being engagable into the recesses adjacent to the open end of the inner tube.

2. The lipstick case of claim 1, wherein the slots of the inner tube extend in a direction parallel to a longitudinal axis of the inner tube.

3. The lipstick case of claim 1, wherein the secondary cams are out of alignment with the slots.

4. The lipstick case of claim 1, wherein the lipstick holder includes a pin extending from a base of the lipstick holder for retaining lipstick in the lipstick holder.

5. The lipstick case of claim 4, wherein the pin includes a tip having at least one lug for engaging the lipstick.

6. The lipstick case of claim 1, wherein the lipstick holder includes axially extending ribs on an inner surface thereof for resisting rotation of lipstick in the lipstick holder.

7. The lipstick case of claim 1, wherein the recesses are located at substantially the same distance from the open end of the inner tube.

* * * * *